US009289640B2

(12) United States Patent
Cersonsky

(10) Patent No.: US 9,289,640 B2
(45) Date of Patent: Mar. 22, 2016

(54) RESISTANCE BRACE

(71) Applicant: Steven M. Cersonsky, Denver, CO (US)

(72) Inventor: Steven M. Cersonsky, Denver, CO (US)

( * ) Notice: Subject to any disclaimer, the term of this patent is extended or adjusted under 35 U.S.C. 154(b) by 177 days.

(21) Appl. No.: 14/095,455

(22) Filed: Dec. 3, 2013

(65) Prior Publication Data

US 2014/0094351 A1 Apr. 3, 2014

Related U.S. Application Data

(63) Continuation-in-part of application No. 12/924,050, filed on Mar. 23, 2009, now abandoned.

(60) Provisional application No. 61/732,804, filed on Dec. 3, 2012.

(51) Int. Cl.

| | |
|---|---|
| ***A63B 21/008*** | (2006.01) |
| ***A63B 21/02*** | (2006.01) |
| ***A63B 21/00*** | (2006.01) |
| ***A63B 71/00*** | (2006.01) |
| ***A63B 21/015*** | (2006.01) |
| ***A63B 23/12*** | (2006.01) |
| ***A63B 23/035*** | (2006.01) |
| ***A63B 23/04*** | (2006.01) |

(52) U.S. Cl.

CPC ..... *A63B 21/015* (2013.01); *A63B 21/0004* (2013.01); *A63B 21/008* (2013.01); *A63B 21/00069* (2013.01); *A63B 21/1403* (2013.01); *A63B 21/4017* (2015.10); *A63B 21/4021* (2015.10); *A63B 21/4025* (2015.10); *A63B 21/4047* (2015.10); *A63B 23/03508* (2013.01); *A63B 23/0494* (2013.01); *A63B 23/1281* (2013.01); *A63B 21/4049* (2015.10); *A63B 23/1245* (2013.01); *A63B 2209/08* (2013.01); *A63B 2209/10* (2013.01); *A63B 2210/50* (2013.01)

(58) Field of Classification Search

USPC ..... 482/44–50, 79, 80, 92, 114–120; 602/5, 602/20, 21, 26, 27

See application file for complete search history.

(56) References Cited

U.S. PATENT DOCUMENTS

| | | | | |
|---|---|---|---|---|
| 2,832,334 | A * | 4/1958 | Whitelaw | 601/33 |
| 4,524,764 | A | 6/1985 | Miller et al. | |
| 4,554,913 | A | 11/1985 | Womack et al. | |
| 4,718,665 | A | 1/1988 | Airy et al. | |
| 4,861,023 | A | 8/1989 | Wedman | |

(Continued)

OTHER PUBLICATIONS

International Search Report and Written Opinion (PCT/US2014/068364); Mar. 31, 2015.

*Primary Examiner* — Oren Ginsberg
(74) *Attorney, Agent, or Firm* — Dunlap Codding, P.C.

(57) ABSTRACT

A resistance brace includes a pair of hinged arms having plates cooperating with one another to define a first and second pivots point separated from one another by a distance. A pair of splints having limb-attachment portions and geared ends engaged with one another and pivotably coupled with the plates at the pivot points. An adjustable compression member is coupled with the plates to compress the plates against the geared ends so as to frictionally impede movement of the splints relative to the plates. A joint harness is coupled with the hinged arms to attach the resistance brace to a joint of a body so that the hinged arms are positioned on opposing sides of the joint relative to a plane of rotation of the joint. Attachment members are coupled with the splints to attach the resistance brace to a first and second body portions extending from the joint.

17 Claims, 7 Drawing Sheets

(56) References Cited

U.S. PATENT DOCUMENTS

| | | | | | |
|---|---|---|---|---|---|
| 4,865,024 | A | | 9/1989 | Hensley et al. | |
| 5,052,379 | A | | 10/1991 | Airy et al. | |
| 5,358,469 | A | | 10/1994 | Patchel et al. | |
| 5,472,412 | A | | 12/1995 | Knoth | |
| 5,599,283 | A | | 2/1997 | Lindenmeyer et al. | |
| 5,658,241 | A | | 8/1997 | Deharde et al. | |
| 5,788,618 | A | | 8/1998 | Joutras | |
| 5,807,294 | A | * | 9/1998 | Cawley et al. | 602/26 |
| 5,865,714 | A | | 2/1999 | Marlowe | |
| 5,954,621 | A | | 9/1999 | Joutras et al. | |
| 5,976,063 | A | | 11/1999 | Joutras et al. | |
| 5,980,435 | A | | 11/1999 | Joutras et al. | |
| 6,139,476 | A | * | 10/2000 | Gallant | 482/114 |
| RE37,209 | E | * | 6/2001 | Hensley et al. | 602/26 |
| 6,497,640 | B2 | | 12/2002 | Loft et al. | |
| 6,500,138 | B1 | | 12/2002 | Irby et al. | |
| 6,666,837 | B2 | * | 12/2003 | Weihermuller | 602/16 |
| 6,872,187 | B1 | | 3/2005 | Stark et al. | |
| 6,953,442 | B2 | | 10/2005 | Yamasaki et al. | |
| 6,960,177 | B2 | * | 11/2005 | Turrini et al. | 602/26 |
| 7,410,471 | B1 | | 8/2008 | Campbell et al. | |
| 8,066,653 | B2 | * | 11/2011 | Seon | 602/19 |
| 2005/0107726 | A1 | | 5/2005 | Oyen et al. | |
| 2006/0155229 | A1 | | 7/2006 | Ceriani et al. | |
| 2008/0097269 | A1 | | 4/2008 | Weinberg et al. | |
| 2008/0108917 | A1 | | 5/2008 | Joutras et al. | |
| 2008/0108918 | A1 | | 5/2008 | Joutras et al. | |
| 2010/0160844 | A1 | | 6/2010 | Gilbert et al. | |
| 2011/0065553 | A1 | | 3/2011 | Cersonsky | |
| 2011/0306911 | A1 | | 12/2011 | Tran | |

* cited by examiner

RESISTANCE BRACE

CROSS-REFERENCE TO RELATED APPLICATIONS AND INCORPORATION BY REFERENCE STATEMENT

This application is a continuation-in-part of U.S. Ser. No. 12/924,050, filed on Mar. 23, 2009, and claims priority to U.S. provisional application Ser. No. 61/732,804 filed Dec. 3, 2012, the entire disclosures of both of which are hereby expressly incorporated herein by reference.

BACKGROUND

With the proliferation of exercise equipment and workout facilities, including home equipment, and the shortening of leisure time for many, it would be convenient to have inexpensive, wearable personal workout equipment that could be implemented and used without occupying the hands of the user.

Existing devices and methods of developing muscles use free weights or exercise machines designed to target a particular muscle or muscle group. Free weights work against gravity and typically work one muscle group and apply resistance in only one direction at a time. Also, the use of free weights excludes other activities as the user holds the free weights with their hand or hands. Free weights are generally not readily adjustable and prevent the user from engaging in activities which require using hands such as household chores, typing, operating doors, holding a book, or gardening. Further, free weights are bulky and heavy and cannot be transported easily.

Exercise machines are generally not portable, take up a large amount of space, and work only specifically targeted muscles or muscle groups, although they are generally somewhat adjustable. Exercise machines typically need the user's full attention, occupy one or both of the user's hands, and are not easily affordable.

SUMMARY

In one aspect, the inventive concepts disclosed herein are directed to a hinged arm assembly for a resistance brace. The hinged arm assembly includes a first and a second plates movably coupled with one another in an opposing spaced-apart relationship so that the first and second plates are selectively movable toward one another and away from one another, the first and second plates cooperating with one another to define a first pivot point and a second pivot point separated from the first pivot point by a first distance. A first splint has a first limb-attachment portion and a first geared end positioned between the first and second plates and pivotably coupled with the first and second plates at the first pivot point. A second splint has a second limb-attachment portion and a second geared end positioned between the first and second plates and pivotably coupled with the first and second plates at the second pivot point, the second geared end matingly engaging the first geared end so that the first and second splints are movable in unison with one another relative to the first and second plates. A compression member is coupled with the first and the second plates such that the adjustable compression member compresses the first and second plates against the first and second geared ends so as to frictionally impede movement of the first and second splints relative to the first and second plates.

In another aspect, the inventive concepts disclosed herein are directed to a resistance brace, including a pair of hinged arms. Each hinged arm has a first and a second plates movably coupled with one another in an opposing spaced-apart relationship so that the first and second plates are selectively movable toward one another and away from one another, the first and second plates cooperating with one another to define a first pivot point and a second pivot point separated from the first pivot point by a first distance. Each hinged arm also has a first splint having a first limb-attachment portion and a first geared end positioned between the first and second plates and pivotably coupled with the first and second plates at the first pivot point, and a second splint having a second limb-attachment portion and a second geared end positioned between the first and second plates and pivotably coupled with the first and second plates at the second pivot point, the second geared end matingly engaging the first geared end so that the first and second splints are movable in unison with one another relative to the first and second plates. An adjustable compression member is coupled with the first and the second plates such that the compression member compresses the first and second plates against the first and second geared ends so as to frictionally impede movement of the first and second splints relative to the first and second plates. A joint harness is coupled with the pair of hinged arms and supporting the pair of hinged arms in an opposing spaced-apart relationship and to attach the resistance brace to a joint of a body so that the pair of hinged arms are positioned on opposing sides of the joint relative to a plane of rotation of the joint. A first attachment member is coupled with the first splints of the pair of hinged arms and configured to attach the resistance brace to a first body portion extending from the joint. A second attachment member is coupled with the second splints of the pair of hinged arms and configured to attach the resistance brace to a second body portion extending from the joint.

In a further aspect, the inventive concepts disclosed herein are directed to a hinged arm assembly for a resistance brace. The hinged arm assembly includes a housing defining a first pivot point and a second pivot point separated from the first pivot point by a first distance. A first splint having a first limb-attachment portion and a first geared end is pivotably coupled with the housing at the first pivot point. A second splint having a second limb-attachment portion and a second geared end is pivotably coupled with the housing at the second pivot point, the second geared end matingly engaging the first geared end so that the first and second splints are movable in unison with one another relative to the housing. A rotary dashpot assembly is incorporated in the housing and operably coupled with the first and the second splints such that the adjustable rotary dashpot assembly impedes movement of the first and second splints relative to the housing in all directions.

BRIEF DESCRIPTION OF THE DRAWINGS

Like reference numerals in the figures represent and refer to the same or similar element or function. Implementations of the inventive concepts disclosed herein may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1:
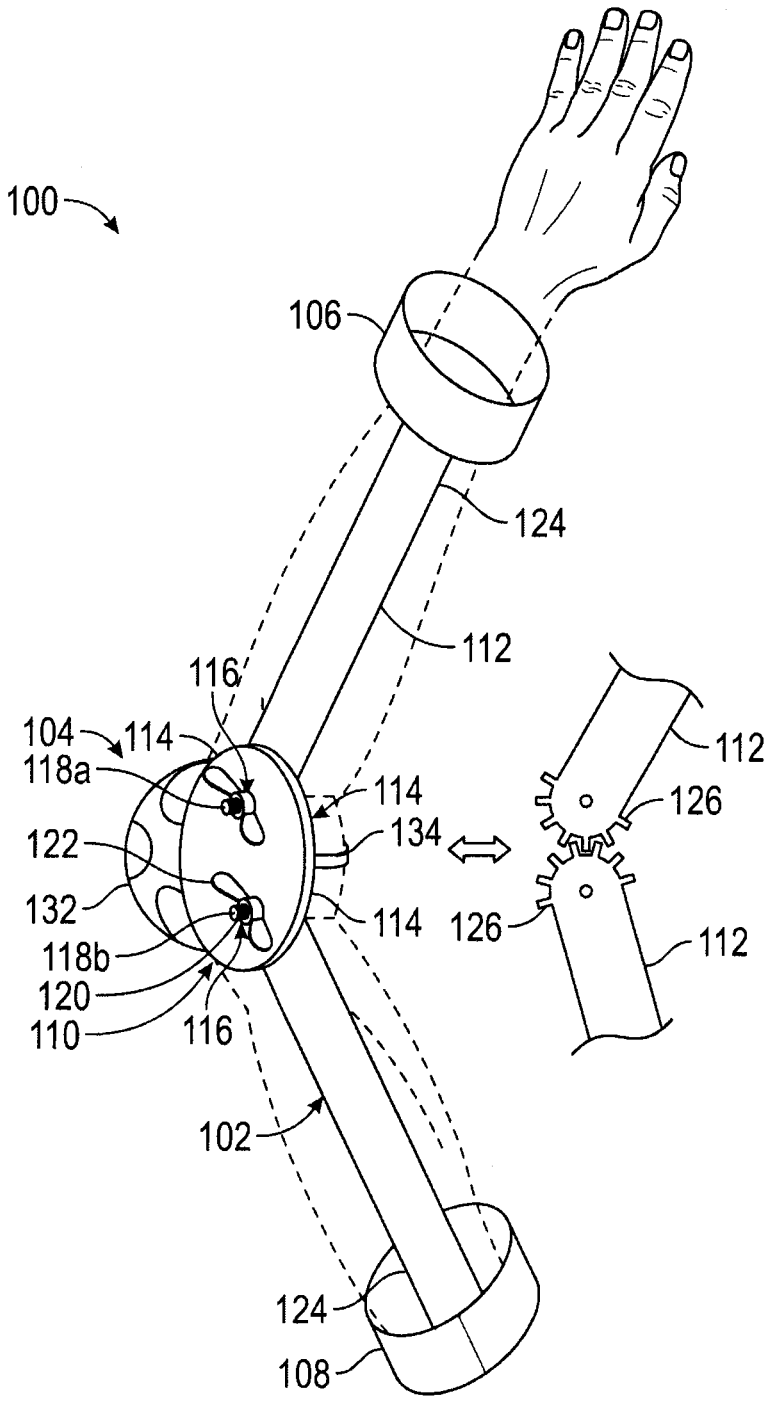
FIG. 1 is a perspective view of an embodiment of a resistance brace according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting.

In the following detailed description of embodiments of the inventive concepts disclosed herein, numerous specific details are set forth in order to provide a more thorough understanding of the inventive concepts. However, it will be apparent to one of ordinary skill in the art that the inventive concepts disclosed herein may be practiced without these specific details. In other instances, well-known features have not been described in detail to avoid unnecessarily complicating the instant disclosure.

As used herein the notation "a-n" appended to a reference numeral is intended as merely convenient shorthand to reference one, or more than one, and up to infinity, of the element or feature identified by the respective reference numeral (e.g., 100*a-n*). Similarly, a letter following a reference numeral is intended to reference an embodiment of the feature or element that may be similar, but not necessarily identical, to a previously described element or feature bearing the same reference numeral (e.g., 100, 100*a*, 100*b*, etc.). Such shorthand notations are used for purposes of clarity and convenience only, and should not be construed to limit the inventive concepts disclosed herein in any way, unless expressly stated to the contrary.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

As used herein the qualifiers "about," "approximately," and "substantially" are intended to include not only the exact value, amount, degree, orientation, or other qualified characteristic or value, but are intended to include some slight variations due to measuring error or precision, manufacturing tolerances, stress exerted on various parts or components, observer error, wear and tear, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment. The inventive concepts disclosed herein are intended to encompass any combinations, subcombinations, and permutations of one or more of the features of the embodiments described herein.

Exemplary embodiments of the inventive concepts disclosed herein provide easy to use and effective devices and methods of body building, which include a wearable resistance braces that are adjustable, affordable, lightweight, portable, safe, effective, expedient, and unobtrusive. Resistance braces according to embodiments of the inventive concepts disclosed herein are configured to be mounted to a human body to resist normal daily body movements to promote muscle grow and to build and tone muscles and adjacent tissues. Exemplary embodiments include a reusable frame which easily affixes to a user's body adjacent to a body joint, and articulates around a geared polycentric hinge which can be adjusted for resistance to impede or resist motion of the joint in all directions.

Embodiments of resistance braces according to the inventive concepts disclosed herein are configured to fit flush to the body as a molded partial exoskeleton frame and may have certain aesthetic design elements to appeal to a target market group, such as artwork, or body sculpting form, for example. Further, embodiments of a resistance brace according to the inventive concepts disclosed herein are easy to wear (e.g., over or under normal clothing) and remove without damage or alteration to clothing and can be stored and adjusted easily. Some embodiments of resistance braces according to the inventive concepts disclosed herein may also offer some side benefit as armor, or may function as an exoskeleton.

In some embodiments, resistance braces according to the inventive concepts disclosed herein are configured to be applied to a human arm about the elbow joint, allowing the resistance brace to concentrate resistance on the biceps and triceps muscle groups of the arm without interfering with use of hands and normal manual dexterity and hand movement. For example, elbow resistance braces according to the inventive concepts disclosed herein may be mounted to a user's arm at the elbow joint using elastic and hook and loop bindings, such as straps, so that the user's hand use or movements are not encumbered by the elbow resistance brace.

Embodiments of resistance braces according to the inventive concepts disclosed herein include paired or dual polycentric hinges which have adjustable resistance. Some embodiments of polycentric hinges may use frictional resistance and implement adjustment members such as wing nuts or tabs, which are tightened to increase the frictional resistance or loosened to decrease frictional resistance. Frictional resistance is inexpensive and therefore affordable to implement and manufacture, yet offers a reasonably adjustable method of changing the resistance for individual use. For example, frictional members may be positioned between opposing pressure plates of a polycentric hinge to further add frictional resistance to the polycentric hinge in some embodiments.

Polycentric hinges according to the inventive concepts disclosed herein may include dual pivot points to allow two splints geared together to move in unison. This allows the combining of the resistance at each pivot point of the polycentric hinges. In some embodiments, an adjustable rotary dashpot design may be implemented to provide resistance, where movement of the polycentric hinge forces fluid through an adjustable restricted passage to provide resistance to movement.

Further, embodiments of resistance braces according to the inventive concepts disclosed herein focus on several physical problem areas increasing in our ever sedentary population. One is the adipose tissue surrounding the triceps muscle. Because of the long term low resistance (versus short period, low repetition, high load), resistance braces according to the inventive concepts disclosed herein have a relatively quick effect of toning the muscle groups and burning fat, and have the additional benefit of fighting osteoporosis, strengthening bone, cartilage, and ligaments.

Some embodiments of the present disclosure include resistance braces having a paired polycentric hinge, which includes two (or more) splints linked to one another by gears so that their movement is coordinated, and movement of the polycentric hinge is impeded by friction and/or by a rotary dashpot. One feature of some embodiments may be the angle that the polycentric hinges are applied to the joint. For example, the paired polycentric hinges may be configured to intersect with a plane defined by the rotational centers of the two bones that meet at the joint at a predetermined angle. In some embodiments, where a resistance brace according to the inventive concepts disclosed herein is applied to a normal healthy adult human elbow joint, the angle may be approximately 40°. The paired pivot points of the polycentric hinges are geared together so that both braces move in unison to combine the resistance at each polycentric hinge at both pivot points. Further, the paired pivot points allow resistance braces according to the inventive concepts disclosed herein to be attached to a user's body such that the polycentric hinges are aligned with the bones to imitate the movement of the body's joint, without undue movement of the resistance brace relative to the skin surface at the points where the resistance brace is attached to the user's joint, limb, or body.

Those skilled in the art will readily recognize that some embodiments of resistance braces according to the inventive concepts disclosed herein can be implemented with various modifications, such as but not limited to, various shapes, sizes, materials, including fabric, leather or metal, fasteners or elements for receiving fasteners, joint or limb anchoring methods and components, different resistance sources, and combinations thereof.

Further, embodiments of resistance braces according to the inventive concepts disclosed herein may be implemented with exercise systems for any part of the body, including in no-gravity or low-gravity environments. The use of resistance braces according to the inventive concepts disclosed herein also extends beyond exercise into health applications, such as rehabilitation, or use to inhibit spastic or uncontrolled movement, such as in the case of some neurological disorders or diseases. In some embodiments, appropriately sized resistance braces according to the inventive concepts disclosed herein can also be used as a supplement to an athlete's workout. Thus, embodiments of the inventive concepts disclosed herein provide a wearable lightweight, low-cost, safe, effective, and expedient resistance braces for exercising a group of muscles and building muscle/bone/cartilage/tendon strength.

Figure 2:
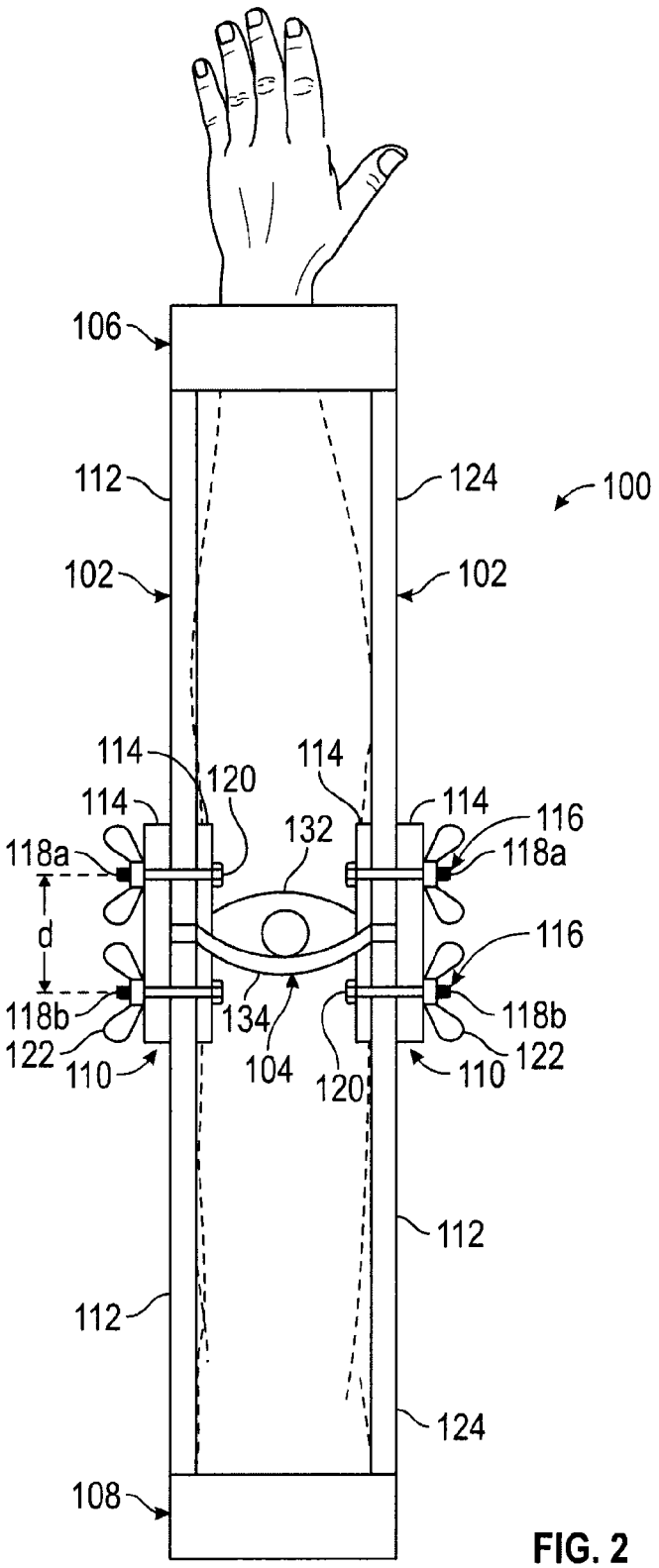
FIG. 2 is a top plan view of the resistance brace of FIG. 1.

Referring now to the drawings, and to FIGS. 1-2 in particular, shown therein is an embodiment of a resistance brace 100 according to the inventive concepts disclosed herein. The resistance brace 100 is configured to be used with an adult human elbow and includes a pair of hinged arms 102, an elbow harness 104 supporting the hinged arms 102 in a spaced-apart relationship, a wrist connector 106 coupled with the hinged arms 102, and an upper arm connector 108 coupled with the hinged arms 102.

The pair of hinged arms 102 includes two hinged arms 102 which are substantially identical to one another (e.g. mirror images of one another). Accordingly, a single hinged arm 102 will be described in detail herein to avoid unnecessarily complicating the instant disclosure. The hinged arm 102 includes a polycentric hinge 110 and a pair of splints 112. The splints 112 are movably coupled with one another and with the polycentric hinge 110 as will be described below.

The polycentric hinge 110 includes a pair of opposing plates 114 movably coupled with one another by a compression assembly 116 such that the opposing plates 114 are movable towards and away from one another and such that the opposing plates 114 are compressed towards one another by the compression assembly 116.

The opposing plates 114 cooperate with one another to define at least two pivot points including a first pivot point 118*a* and a second pivot point 118*b*. The pivot points 118*a* and 118*b* are separated from one another by a predetermined distance d (FIG. 2), which may be about 3 cm where the resistance brace 100 is configured to be applied to a typical adult human elbow or may range from about 2 cm to about 4 cm in some embodiments. In some embodiments, the opposing plates 114 may cooperate to define any desired number of pivot points 118*a-n*, such as three or more pivot points 118*a-n*.

The opposing plates 114 may be implemented as compression plates or pressure plates and may have substantially flat opposing surfaces. The opposing plates 114 may be constructed of any desired material, such as metals, alloys, resilient plastics, polymers, ceramic materials, resins, fibrous materials, and combinations thereof, and may be manufactured in any desired fashion, such as by machining, casting, molding, and combinations thereof.

The compression assembly 116 includes one or more connectors 120 and one or more compression members 122 movably coupled with the connectors 120. The connectors 120 are shown as being coupled with the opposing plates 114 such that the connectors 120 are coupled with a first plate 114 and extend through both opposing plates 114 at each of the pivot points 118*a* and 118*b*. The connectors 120 may be implemented as threaded shafts, fasteners, pins, axles, rivets, cams, clamps, or in any other desired manner such that the connectors 120 movably couple the opposing plates 114 in an opposing spaced-apart relationship so that the opposing plates 114 are movable toward and away from one another. The connectors 120 may be constructed of any desired materials such as metals, alloys, non-metals, resilient plastics, resins, polymers, ceramics, and combinations thereof.

The compression members 122 are movably coupled with the connectors 120 (e.g., threadingly or otherwise movable engaged) so that the opposing plates 114 can be compresses between the connectors 120 and the compression members 122 and may be moved towards or away from one another by moving the compression members 122 relative to the connectors 120. In the embodiment shown in FIGS. 1-2, the compression members 122 are shown as wingnuts, and may be implemented as flush nuts, threaded knobs, clamps, brackets, fasteners, or in any other desired manner such that the compression members 122 are movable relative to the connectors 120 so as to compress the opposing plates 114 between the compression members 122 and the connectors 120.

It is to be understood that any desired number of connectors 120 and compression members 122 may be implemented with the inventive concepts disclosed herein, and that in some embodiments the connectors may couple the opposing plates 114 at locations other than the pivot points 118*a* and 118*b*.

Each of the splints 112 includes a limb-attachment portion 124 and a geared end 126 (FIG. 1). The limb-attachment portions 124 are configured to connect the splints 112 to a limb of body part articulated by a joint such as via the wrist connector 106 or the upper arm connector 108 as will be described below.

The geared ends 126 are configured to be positioned between the opposing plates 114 and movably or pivotably coupled with the opposing plates 114. The geared ends 126 matingly engage with one another at the pivot points 118*a* and 118*b*. For example, the geared ends 126 may be coupled with the connectors 120 of the compression assembly 116 and may be positioned or sandwiched between the opposing plates 114 such that portions of the geared ends 126 and/or of the splints 112 frictionally engage one or more surfaces of the opposing plates 114 when the opposing plates 114 are compressed by the compression assembly 116 so that the splints 112 are compressed between the opposing plates 114 so that movement of the splints 112 relative to the polycentric hinge 110 is frictionally impeded or resisted. The gearing coupling the geared ends 126 may be of any size, dimensions, or configuration, provided that the geared ends 126 matingly engage one another such that the two splints 112 of the hinged arm 102 move in unison relative to the polycentric hinge 110.

Further, the geared ends 126 of the splints 112 matingly engage one another such that the splints 112 move in unison with one another relative to the polycentric hinge 110. For example, forces applied to a first one of the splints 112 cause a second one of the splints 112 whose geared end 126 matingly engages the geared end 126 of the first one of the splints 112 to move relative to the polycentric hinge 110, and vice versa, and the frictional resistances between the opposing plates 114 and each of the splints 112 are additive to form an overall frictional resistance of the polycentric hinge 110. In some embodiments, the frictional or contacting surfaces of the opposing plates 114 and the splints 112 are configured such that the frictional resistance between the opposing plates and the splints is applied in all movement directions, and such that the frictional resistance between the opposing plates 114 and the splints 112 is substantially constant and independent on the angle or position of the splints 112 relative to the opposing plates 114.

Figure 3A:
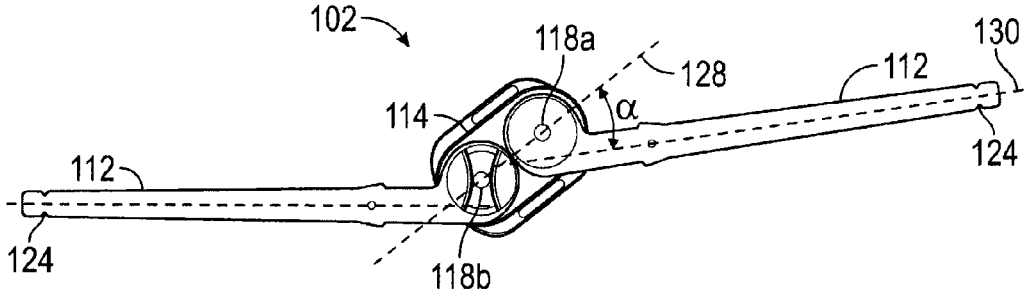
FIG. 3A is a side view of a hinge arm of the resistance brace of FIG. 2 shown in an extended position.
Figure 3B:
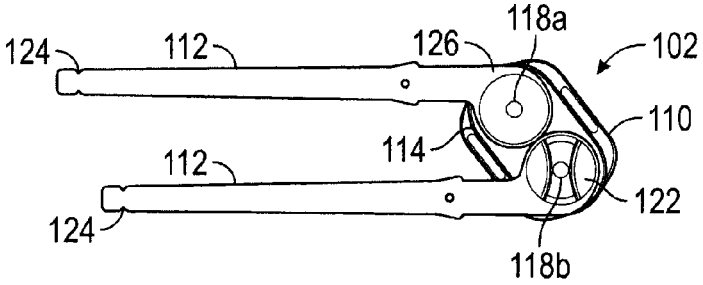
FIG. 3B is a side view of the hinge arm of FIG. 3A shown in a flexed position.

The splints 112 are movable relative to the opposing plates 114 of the polycentric hinge 110 such that the hinged arm 102 is movable between an extended position as shown in FIG. 3A and one or more flexed positions as shown in FIG. 3B. In some exemplary embodiments, when the hinged arm 102 is in the extended position as shown in FIG. 3A, an axis 128 defined by the pivot points 118*a* and 118*b* may intersect an axis 130 of one of the splints 112 at an angle $\alpha$, which in the case of an adult human elbow joint may be about 40° as will be appreciated by a person of ordinary skill in the art having the benefit of the instant disclosure. As will be appreciated by persons of ordinary skill in the art, in some embodiments one or both of the splints 112 may have geared ends 126 or other portions angled relative to the respective limb-attachment portions 124 at any desired angle (e.g., between about 36° and about 44°) such that the axis 128 intersects the axis 130 of one of the splints 112 at the angle $\alpha$. Further, in some embodiments, the angle $\alpha$ may be about 40° or may range from about 36° to about 44°.

The splints 112 may be made of any desired material such as metals, alloys, non-metals, resilient plastics or resins, nylon, ceramics, rubber materials, wood, natural materials, fibrous materials, and combinations thereof. Some exemplary embodiments of the splints 112 may include a soft breathable and removable liner coupled with the splints 112, the liner configured to provide a soft and absorbent contact surface between the splints 112 and the user's arm, as will be appreciated by persons of ordinary skill in the art having the benefit of the instant disclosure.

In some embodiments, one or more friction members may be positioned between one or more of the geared ends 126 and the opposing plates 114 so as to enhance, reduce, or otherwise regulate the frictional resistance of the polycentric hinge 110. For example, the friction members may be implemented as friction washers, or disks, and may be constructed of any desired material, such as natural or synthetic rubber, resins, fibrous material, polymers, natural materials, textile materials, ceramic materials, and combinations thereof.

Referring back to FIGS. 1-2, the elbow harness 104 includes an elbow cradle 132 and a retaining strap 134. The elbow harness 104 is coupled to the polycentric hinges 110 of the hinged arms 102 such that the elbow harness 104 supports the hinged arms 102 in a spaced apart relationship so that a human elbow is at least partially positionable in the elbow harness 104 and so that each of the hinged arms 102 is positionable on opposing sides of the user's elbow and oriented substantially perpendicularly to a plane of rotation of the user's elbow. The elbow harness 104 may cooperate with the pair of hinged arms 102 to define a joint-receiving space therebetween. The elbow harness 104 holds the hinged arms 102 firmly in place and maintains the relative location of the hinged arms 102 without altering or damaging clothing, without impeding range of motion of the elbow, or cutting off circulation or compressing the nerves of the user's arm.

The elbow harness 104 may be constructed of fabric, plastic, leather, or hook-and-loop fastener, and/or a combination thereof (e.g., in the form of a strap, rope, cable, cuff, or donut). In addition, the elbow harness 104 may include any desired mechanisms of adjusting the length, size and/or tension of the elbow cradle 132 and/or the retaining strap 134.

The elbow cradle 132 is substantially inelastic (e.g., to minimize or substantially prevent movement or shifting of the resistance brace 100 during use). The elbow cradle 132 may be implemented as a donut, of other appropriately shaped member configured such that an elbow may be at least partially positioned or cradled therein (e.g., substantially centered), and may include an opening allowing a portion of the elbow to protrude therefrom. The elbow cradle 132 may be constructed of a soft and substantially inelastic material (e.g., breathable textiles, fabrics, closed cell foam plastic materials, or polymeric materials) such that the elbow cradle 132 provides a comfortable padding to the elbow while firmly retaining the resistance brace 100 in place and minimizing shifting or movement of the resistance brace 100 relative to the elbow during use.

The retaining strap 134 may be implemented as a flexible strap or band of any desired material (e.g., textiles, polymeric materials, fabrics, closed cell foam plastic materials, or leather), and is coupled with the polycentric hinges 110 opposite the elbow cradle 132 and spaced at a distance therefrom such that the retaining strap 134 engages a user's forearm adjacent to the user's elbow or other joint when the user's elbow is positioned in the elbow harness 104. The retaining strap 134 is adjustable to securely retain the elbow or other joint in the elbow cradle 132 without cutting off circulation of compressing the nerves in the user's arm, so as to avoid causing swelling or numbness in the user's arm as will be appreciated by persons of ordinary skill in the art having the benefit of the instant disclosure.

The wrist connector 106 and the upper arm connector 108 may be implemented similarly to one another and may be constructed of a washable material such as closed cell foam plastic with a soft smooth interior, giving it an openable hoop or cuff structure.

The wrist connector 106 is coupled with the limb-attachments portions 124 of the splints 112 of the pair of hinged arms 102, such that the wrist connector 106 does not bind the wrist, but allows freedom of movement so the wrist can twist within the wrist connector 106 (e.g., to freely twist and/or turn so as to move the user's hands in a full range of motion between a pronate and a supinate positions). The wrist connector 106 may be implemented as a cuff or a retaining band or ring, and may have adjustable size, width, and tension, such as via one or more snaps, buttons, zippers, hook-and-loop fasteners, laces, strings, elastic bands, buckles, magnets, or any other fastening devices or methods. In some embodiments, the wrist connector 106 may be wrapped around or otherwise attached to the splints 112, and in some embodiments, the wrist connector 106 may be coupled with the splints 112 via an adhesive or a hook-and-loop fastener.

The upper arm connector 108 is coupled to the limb-attachment portions 124 of the splints 112 of the hinged arms 102 and is configured to fit the splints 112 of the hinged arms 102 to connect the pair of hinged arms 102 of the resistance brace 100 firmly on opposite sides of the user's upper arm. In some embodiments, the upper arm connector 108 may be wrapped around or otherwise attached to the splints 112, and in some embodiments, the upper arm connector 108 may be coupled with the splints 112 via an adhesive or a hook-and-loop fastener. The upper arm connector 108 is adjustable to the size of the upper arm and fastens across the top of the arm. In some embodiments, the upper arm connector 108 may be designed so that it is connectable with a shoulder hinge and may attach to a total body device including multiple hinged arms and polycentric hinges according to the present disclosure.

In operation, the resistance brace 100 may be used as follows. A user may remove the resistance brace 100 from storage and may open the resistance brace 100. The user may insert one of the user's forearms into the elbow harness 104, such that the elbow harness 104 is positioned over a joint such as the user's elbow so that the elbow cradle 132 is substantially centered over the elbow and the retaining strap 134 fits over the forearm adjacent to the elbow to align the resistance brace 100 to the elbow. The user may fasten the upper arm connector 108 snugly around and over the upper arm of the user, and may fasten the wrist connector 106 around and over the wrist of the user while ensuring that the wrist can rotate freely. The resistance brace 100 may be worn over or under normal clothing as desired by the user. In some embodiments, where the resistance brace 100 is worn under normal clothing, the resistance brace 100 may require no modifications to normal clothing and/or may be configured so as to be virtually undetectable under normal clothing.

To use, the user simply wears the resistance brace 100 during normal daily activities such as working, typing, relaxing, reading a book, or walking. The user may adjust the resistance of the resistance brace 100 by regulating or adjusting the pressure or compressive force exerted on the plates 114 by the compression assembly 116 as described above. Once the desired resistance is found, the user may adjust the compression at each compression assembly 116 so that the resistance at each hinged arm 102 is relatively equal such that the resistance brace 100 does not favor the weakest resistance and potentially contort (e.g., flex laterally) during use. It is to be understood that in some embodiments it may be advantageous for a user to wear a resistance brace 100 on each arm as to avoid favoritism toward an unencumbered arm (e.g., an arm not wearing a resistance brace 100).

As will be appreciated by persons of ordinary skill in the art having the benefit of the instant disclosure, the resistance brace 100 is configured such that the polycentric hinge 110 is anatomically correct and conforms to the normal movement of the user's joint such that when the user moves their arm, the wrist connector 106 and/or the upper arm connector 108 remain relatively stationary relative to the user's arm and do not move or rub against the user's skin. For example, the resistance brace 100 moves anatomically correctly relative to a joint so that the wrist connector 106 and upper arm connector 108 are substantially stationary relative to the first and second body portions when the wrist connector 106 and upper arm connector 108 are attached to the user's body and the resistance brace 100 is moved between the extended position and the two or more flexed positions. This allows users to wear resistance braces such as the resistance brace 100 for prolonged periods of time and with relatively large amounts of resistance added, without causing any pain, discomfort, or injury to the user's skin at the points where the wrist connector 106, the elbow harness 104, and the upper arm connector 108 contact the user's arm.

To remove the resistance brace 100, the user may simply detach the wrist connector 106, and the upper arm connector 108, and slide the elbow out from the elbow cradle 132. The resistance brace 100 can then be folded in half for easy storage.

As will be appreciated by persons of ordinary skill in the art having the benefit of the instant disclosure, the resistance brace 100 may be modified so as to be applicable to a knee joint, by appropriately resizing the wrist connector 106 to fit a user's ankle, the upper arm connector 108 to fit a user's thigh, and reconfiguring the elbow harness 104 to harness a user's knee. For example, the frictional resistance of the polycentric hinges 110 may be increased to accommodate stronger leg muscles. Further, in some embodiments, the upper arm connector 108 may be configured to allow the resistance brace 100 to be coupled or connected with other resistance braces as a part of a partial or full exoskeleton such as knee resistance braces (e.g., having an angle or offset of 0° and a larger radius rotation), shoulder resistance braces (e.g., having 3 dimensions of rotation, and a larger radius), back resistance braces, and other resistance braces implemented similarly to the resistance brace 100 and/or including one or more polycentric hinges similar to the polycentric hinge 110.

Figure 4:
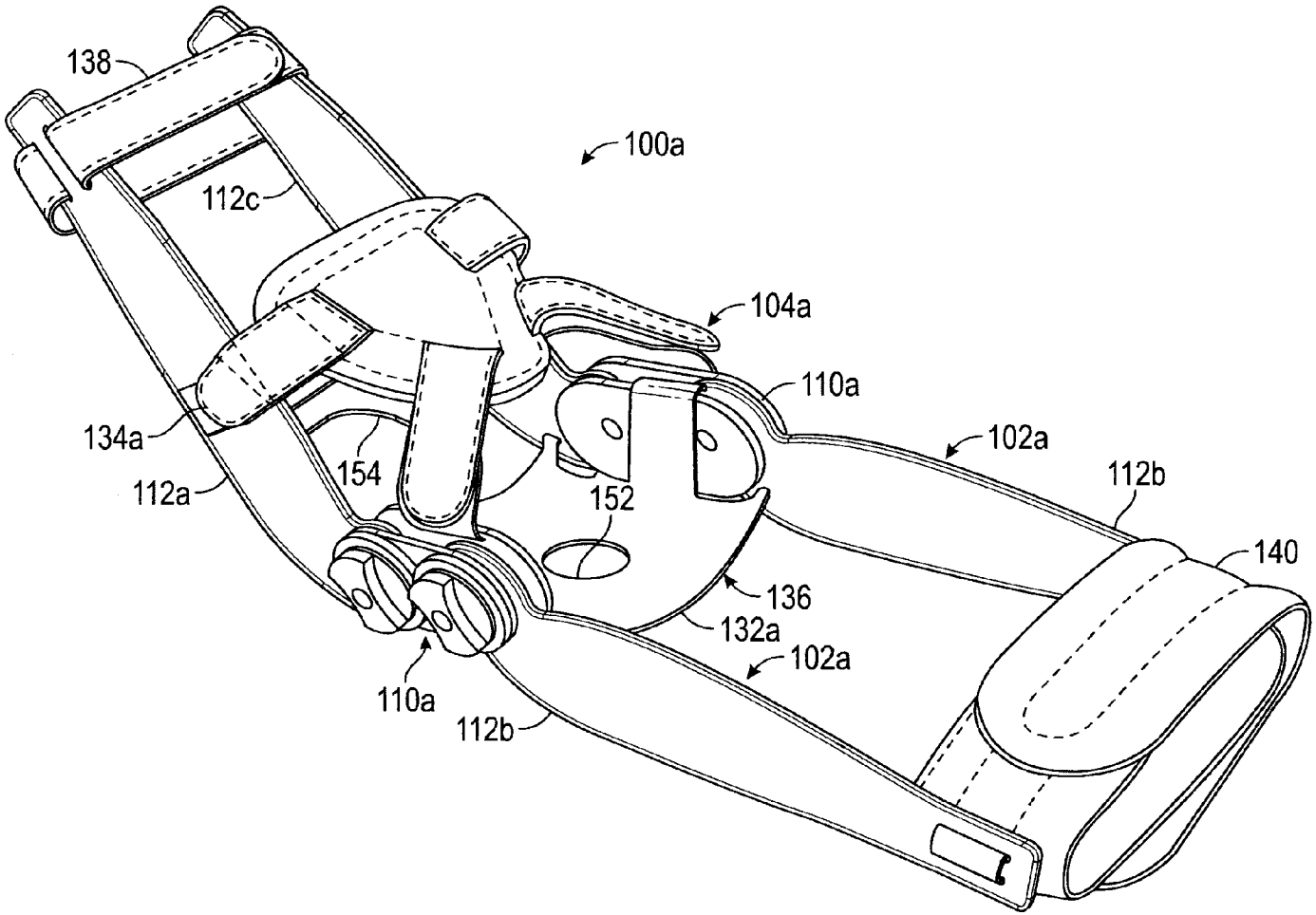
FIG. 4 is a perspective view of an embodiment of a resistance brace according to the inventive concepts disclosed herein.
Figure 5:
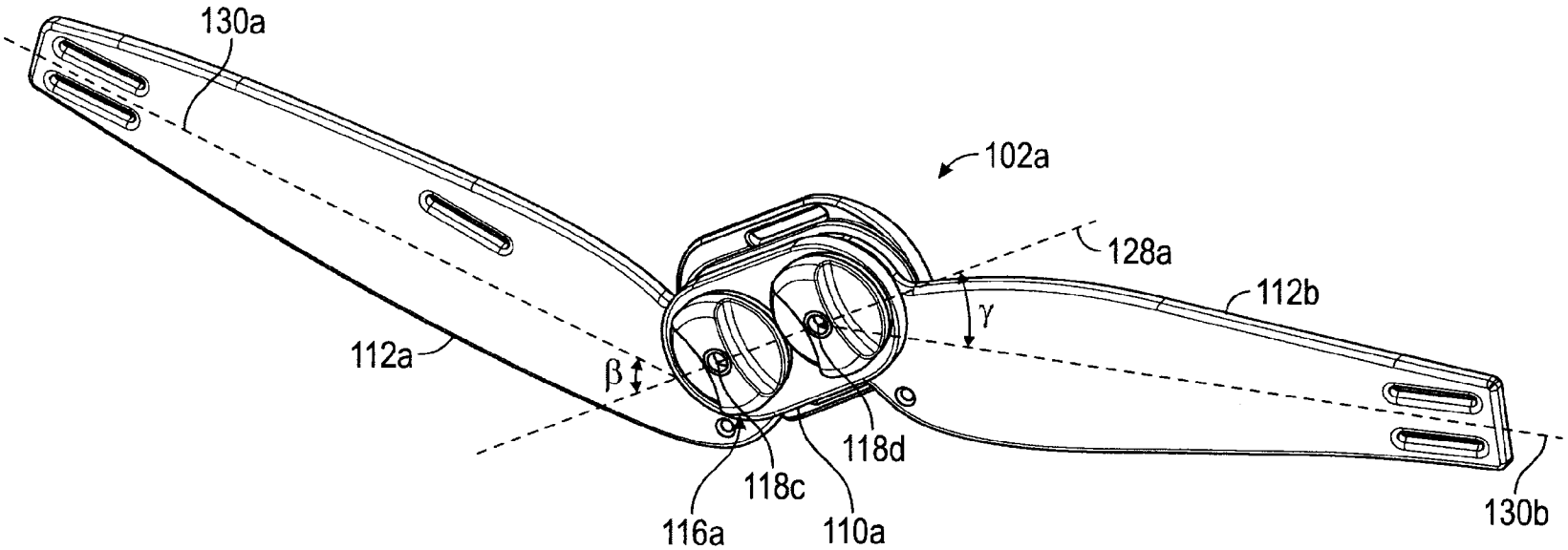
FIG. 5 is a perspective view of an embodiment of a hinge arm of the resistance brace of FIG. 4.
Figure 6:
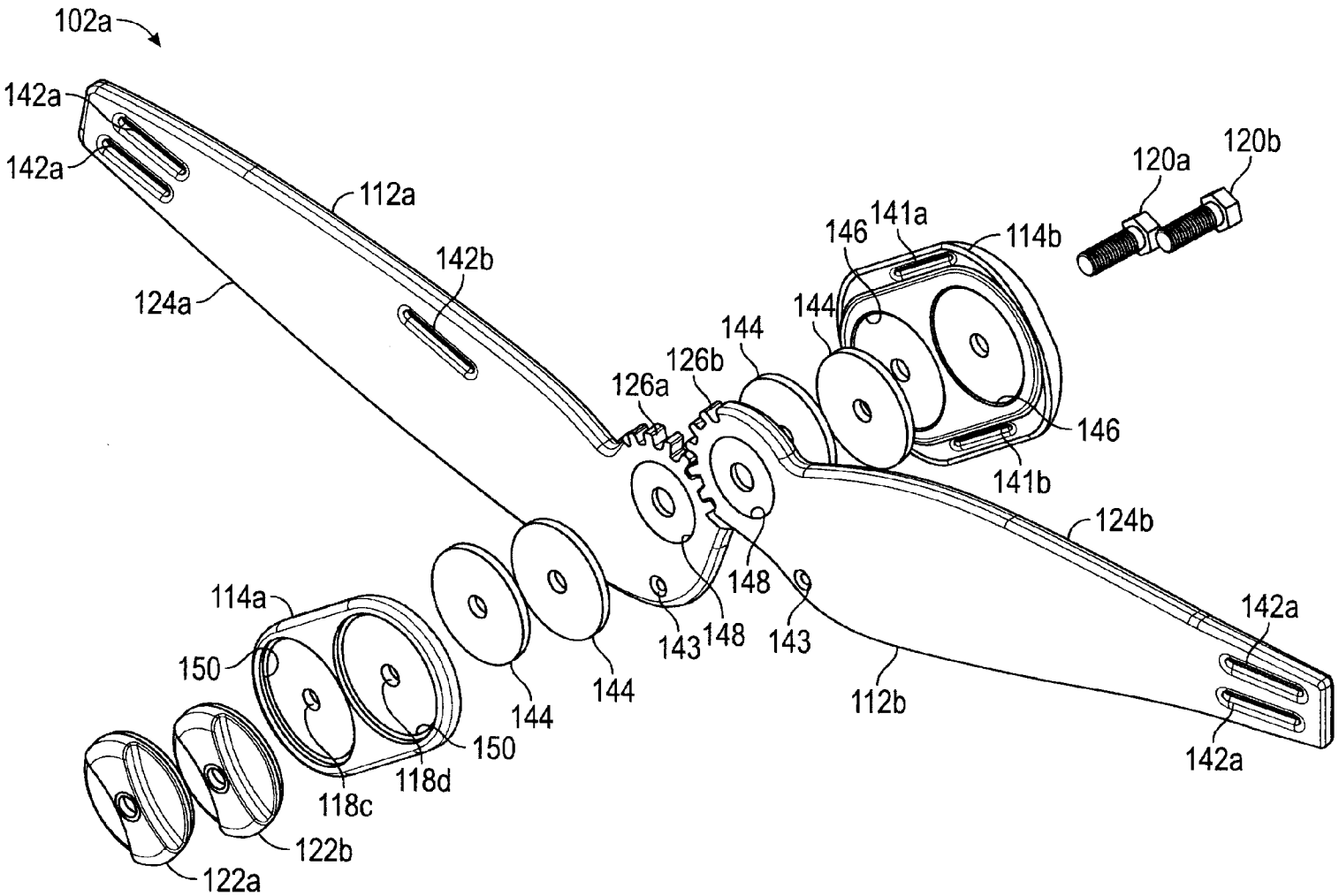
FIG. 6 is an exploded perspective view of the hinge arm of FIG. 5.

Referring now to FIGS. 4-6, shown therein is an embodiment of a resistance brace 100*a* according to the inventive concepts disclosed herein. The resistance brace 100*a* is implemented similarly to the resistance brace 100, and includes hinged arms 102*a*, a joint harness 136, an attachment member 138, and an attachment member 140. The hinged arms 102*a* are substantially identical to one another (e.g., mirror images of one another), and a hinged arm 102*a* will be described herein below in detail to avoid unnecessarily complicating the instant disclosure.

Referring now to FIGS. 5-6, the hinged arm 102*a* may be implemented similarly to the hinged arm 102 and includes a polycentric hinge 110*a*, a splint 112*a*, and a splint 112*b*.

The polycentric hinge 110*a* may be implemented similarly to the polycentric hinge 110 and includes a plate 114*a*, a plate 114*b*, and a compression assembly 116*a*.

The plates 114*a* and 114*b* may be implemented similarly to the plates 114 and are movably coupled with one another (e.g., via the compression assembly 116*a*) in an opposing spaced-apart relationship so that the plates 114*a* and 114*b* are selectively movable toward one another and away from one another. The plates 114*a* and 114*b* cooperate with one another to define pivot points 118*c* and 118*d* separated from one another by a predetermined distance (e.g., about 3 cm). The plate 114*b* may include joint harness notches 141*a* and 141*b*, the joint harness notches 141*a* and 141*b* configured to serve as an attachment point for the joint harness 136 as will be described below.

The splint 112*a* may be implemented similarly to the splint 112 and has a limb-attachment portion 124*a* and a geared end 126*a* positioned between the plates 114*a* and 114*b* and pivotably coupled with the plates 114*a* and 114*b* at the pivot point 118*c*. The limb-attachment portion 124*a* includes one or more notches 142*a* and one or more notches 142*b* formed therein and configured to allow the attachment member 138 to be connected to or otherwise coupled with the limb-attachment portion 124*a*. In some embodiments, the splint 112*a* defines and axis 130*a* and the geared end 126*a* may be angled relative to the axis 130 at an angle β which may be about 40° or may range from about 36° to about 44°.

Further, the splint 112*a* includes one or more attachment opening 143 positioned adjacent to the geared end 126*a*, the attachment opening 143 configured to serve as an attachment point for the joint harness 136 to be coupled with the splint 112*a* as will be described below.

The splint 112*b* may be implemented similarly to the splint 112 and has a limb-attachment portion 124*b* and a geared end 126*b* positioned between the plates 114*a* and 114*b* and pivotably coupled with the plates 114*a* and 114*b* at the pivot point 118*d*. The geared end 126*b* matingly engages the geared end 126*a* so that the splints 112*a* and 112*b* are movable in unison with one another relative to the plates 114*a* and 114*b* between an extended position and one or more flexed positions.

The limb-attachment portion 124*b* includes one or more notches 142*a* formed therein and configured to allow the attachment member 138 to be connected to the limb-attachment portion 124*b*. Further, the splint 112*b* includes one or more attachment opening 143 positioned adjacent to the geared end 126*b*, the attachment openings 143 configured to serve as attachment point for the joint harness 136 to be coupled with the splint 112*b* as will be described below.

In some embodiments, the pivot points 118*c* and 118*d* cooperate with one another to define an axis 128*a* and the splint 112*b* defines an axis 130*b*, the axis 128*a* being angled relative to the axis 130*a* at an angle γ (e.g., about 40° or ranging from about 36° to about 44°) when the splints 112*a* and 112*b* are in the extended position. As will be appreciated by persons of ordinary skill in the art having the benefit of the instant disclosure, embodiments of resistance braces may have different angles or offsets determined by the relative angles of the centers of rotation for each bone relative to the normal open angle of the particular joint to which the resistance brace 100*a* is configured to be applied to.

The compression assembly 116*a* may be implemented similarly to the compression assembly 116 and includes connectors 120*a* and 120*b*, compression members 122*a* and 122*b*, and one or more friction members 144. The compression assembly 116*a* is coupled with the plates 114*a* and 114*b* such that the compression assembly 116*a* compresses the plates 114*a* and 114*b* against the geared ends 126*a* and 126*b* so as to frictionally impede movement of the splints 112*a* and 112*b* relative to the plates 114*a* and 114*b* at a substantially constant and uniform level and in all directions as the splints 112*a* and 112*b* move between the extended position and the one or more flexed positions.

The connectors 120*a* and 120*b* are coupled with the plates 114*a* 114*b* and extending through the plates 114*a* and 114*b*. The compression members 122*a* and 122*b* are coupled with the connectors 120*a* and 120*b* respectively and are movable relative to at least one of the plate 114*a* and the plate 114*b* and/or the connectors 120*a* and 120*b* between a first position where the compression members 122*a* compress the plates 114*a* and 114*b* against the geared ends 126*a* and 126*b* with a first compressive force and a second position where the compression members 122*a* compress the plates 114*a* and 114*b* against the geared ends 126*a* and the 126*b* with a second compressive force different from the first compressive force.

The friction members 144 are positioned between the geared end 126*a* and at least one of the plates 114*a* and 114*b*. The friction members 144 may be constructed of any desired material or combination of materials such as natural or synthetic rubber or rubber-type material, polymeric materials, porous materials, fibrous materials, polychloroprene such as Neoprene 50 Duro, textiles, woven materials, alloys, metals, and ceramic materials. An exemplary optimal material may maximize friction while minimizing degradation and may have a medium compression to adjust the amount of friction. In some embodiments, one or more friction members 144 may be positioned between the geared end 126*b* and at least one of the plates 114*a* and 114*b*. In this way, the friction members 144 are compressed between the plate 114*a*, the plate 114*b*, and the geared ends 126*a* and 126*b* by the compression assembly 116*a* to further enhance the frictional resistance of the hinged joint 110*a*.

The plates 114*a* and 114*b* may include friction member engaging notches 146, which may be configured to be substantially flat and may be sized and shaped to correspond to the shape and size of the friction members 144 so as to frictionally engage the friction members 144 and/or to receive the friction members 144 at least partially therein. Further, the geared ends 126*a* and 126*b* may include friction member engaging surfaces 148 on one or both sides thereof configured to align with the friction member engaging notches 146 and to frictionally engage the friction members 144 such that the friction members 144 are compressed or sandwiched between the friction member engaging notches 146 and the friction member engaging surfaces 148. Further, in some embodiments, the plate 114*a* may include one or more compression member notches 150 configured to engage or at least partially receive a compression member 122*a* and/or 122*b* therein. The friction member engaging notches 146 and the friction member engaging surfaces 148 may be configured so as to cooperate with one another to provide a substantially uniform and frictional impediment of the movement of the splints 112*a* and 112*b* relative to the plates 114*a* and 114, which frictional impediment remains substantially constant at all angles of the splints 112*a* and 112*b* relative to the plates 114*a* and 114*b* as the splints 112*a* and 112*b* move between the expanded and the one or more flexed positions.

As will be appreciated by persons of ordinary skill in the art, in some embodiments one or more or all of the friction member engaging notches 146, the friction member engaging surfaces 148, and the compression member notches 150 may be omitted.

Referring back to FIG. 4, the joint harness 136 is coupled with the pair of hinged arms 102*a* and is configured to support the pair of hinged arms 102 in an opposing spaced-apart relationship and to attach the resistance brace 100*a* to a joint of a body so that the pair of hinged arms 102*a* are positioned on opposing sides of the joint relative to a plane of rotation of the joint.

The joint harness 136 may be implemented similarly to the elbow harness 104 and includes a joint cradle 132*a* and a retaining strap 134*a* coupled with the hinged arms 102*a* (e.g., via the notches 141 and/or the attachment openings 143).

The joint cradle 132*a* is implemented similarly to the elbow cradle 132 described above and is coupled to the hinged arms 102*a* via the joint harness notches 141*a* of the plates 114*b* and to the splints 112*a* and 112*b* via the attachment openings 143. Further, the joint cradle 132*a* includes an opening 152 configured to encircle or otherwise surround a part of a joint (e.g., a point of an elbow, a knee cap, a shoulder) so as to center the joint cradle 132*a* onto the joint.

The retaining strap 134*a* is implemented similarly to the retaining strap 134 and is coupled to the hinged arms 102*a* via the joint harness notches 141*b* of the plates 114*b* and to the splints 112*a* via the notches 142*b*. The retaining strap 134*a* and the joint cradle 134*a* are separated at a distance from one another so that the joint cradle 132*a*, the retaining strap 134*a*, and the pair of hinged arms 102*a* cooperate with one another to define a joint-receiving space 154 therebetween.

The attachment member 138 may be implemented similarly to the wrist connector 106 and is coupled with the splints 112*a* of the pair of hinged arms 102*a* via the notches 142*a*. The attachment member 138 is configured to attach the resistance brace 100*a* to a first body portion extending from a joint.

The attachment member 140 may be implemented similarly to the upper arm connector 108 and is coupled with the splints 112*b* of the pair of hinged arms 102*a* via the notches 142*a*. The attachment member 140 is configured to attach the resistance brace 100*a* to a second body portion extending from the joint.

As will be appreciated by persons of ordinary skill in the art having the benefit of the instant disclosure, in some embodiments, the resistance brace 100*a* may include splints 112*a* and 112*b* having limb-attachment portions 124*a* and 124*b* angled relative to one another and/or to the polycentric hinges 110 such that the resistance brace 100 sits substantially flush with the user's limb when in use so that the resistance brace 100*a* can be worn under normal clothing and so that the resistance brace 100*a* is virtually undetectable under normal clothing.

Figure 7:
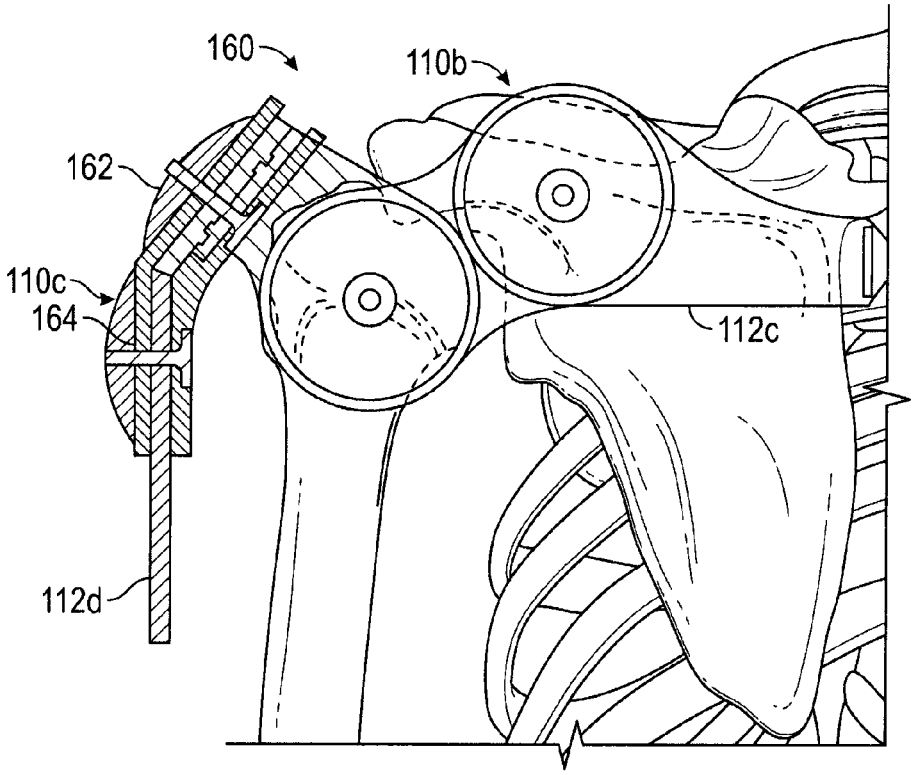
FIG. 7 is a posterior perspective view of a shoulder resistance brace according to the inventive concepts disclosed herein shown attached to a human shoulder.

Referring now to FIG. 7, in some embodiments a shoulder resistance brace 160 according to the inventive concepts disclosed herein may include a pair of polycentric hinges 110*b* and 110*c*, a splint 112*c*, and a splint 112*d*.

The polycentric hinges 110*b* and 110*c* may be implemented similarly to the polycentric hinges 110 and 110*a* described above and may be coupled to one another so as to conform to multiple rotation planes to mimic the three-dimensional movement of a human shoulder joint. For example, one of the polycentric hinges 110*b* may be oriented so as to allow lateral raising and lowering of an arm at the shoulder joint, and another polycentric hinge may be angled so as to allow for anterior and posterior raising and lowering of the arm. In some embodiments, the splint 112*c* may be angled relative to the polycentric hinge 110*b* at any angle which may be about 30° for a typical adult human shoulder, and the polycentric hinge 110*c* may include a first portion 162 including a first pivot point and a second portion 164 including a second pivot point, the first and second portion angled relative to one another at an angle, which may be about 18° for a typical adult human shoulder.

Further, the splint 112*c* may be configured so that a first shoulder resistance brace 160 may be coupled with a second shoulder resistance brace 160 on an opposite shoulder, or with a spinal or back resistance brace in some embodiments, such as via one or more slots, flanges, attachment openings, harnesses, fasteners, or combinations thereof.

Similarly, the splint 112*d* may be configured to couple the shoulder resistance brace 160 with a resistance brace 100 and/or 100*a* as described herein, by being coupled with one or both of the hinges arms 102 and/or 102*a*, such as via one or more fasteners, clamps, brackets, the upper arm connector 108 or the attachment member 140, or combinations thereof, in some embodiments of the inventive concepts disclosed herein.

Figure 8:
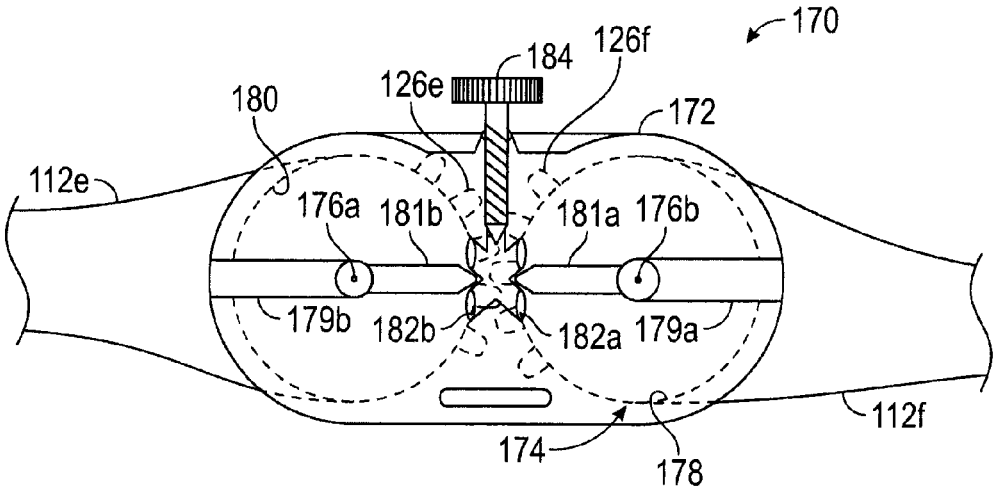
FIG. 8 is an elevational view of an embodiment of a hinge arm with an adjustable rotary dashpot assembly according to the present disclosure.

Referring now to FIG. 8, in some embodiments a hinged arm 170 according to the inventive concepts disclosed herein may include a housing 172, an adjustable rotary dashpot assembly 174, and splints 112*e* and 112*f*.

The housing 172 may define at least two pivot points 176*a* and 176*b* separated at a distance from one another. The splints 112*e* and 112*f* may include geared ends 126*e* and 126*f* matingly engaging one another and movably (e.g., rotatably or pivotally) coupled with the housing 172 at the pivot points 176*a* and 176*b*, such that the splints 112*e* and 112*f* are movable relative to the housing 172 between an extended position and one or more flexed positions.

The adjustable rotary dashpot assembly 174 may be incorporated into the housing 172 and is configured to resist motion via viscous friction. The adjustable rotary dashpot assembly 174 includes a first fluid chamber 178 having a movable fluid displacement member 179*a* coupled with the splint 112*e* and a first resistance member 181*a* and a second fluid chamber 180 including a movable fluid displacement member 179*b* coupled with the splint 112*f* and a second resistance member 181*b*, the fluid chambers 178 and 180 fluidly coupled with one another via fluid passages 182*a* and 182*b*. The fluid displacement members 179*a* and 179*b* are movable (e.g., rotatable) relative to the fluid chambers 178 and 180 such that when the splint 112*e* moves relative to the housing 172 the fluid displacement member 179*a* displaces, moves, pumps, or forces a volume of fluid past the first resistance member 181*a* and from the fluid chamber 178 into the fluid chamber 180 via the fluid passage 182*a*, and so that when the when the splint 112*f* moves relative to the housing 172 the fluid displacement member 179*b* displaces, moves, pumps, or forces a volume of fluid past the second resistance member 181*b* and from the fluid chamber 180 into the fluid chamber 178 via the fluid passage 182*b*. The fluid displacement members 179*a* and 179*b* may be movable in opposing directions (e.g., clockwise and counterclockwise), such that a first volume of fluid flows past the first resistance member 181*a* and from the fluid chamber 178 into the fluid chamber 180 via the fluid passage 182*a*, and a volume of fluid flows past the second resistance member 181*b* and from the fluid chamber 180 into the fluid chamber 178 via the fluid passage 182*b* simultaneously with one another when the splints 112*e* and 112*f* are moved relative to the housing 172 so as to impede the movement of the splints 112*e* and 112*f*.

An adjustment member 184 is movably coupled with at least one of the fluid passages 182*a* and 182*b* so that the adjustment member 184 is movable between a first position where the fluid passage 182*a* or 182*b* has a first diameter or size, and a second position where the fluid passage 182*a* or 182*b* has a second size or second diameter. The fluid passages 182*a* and 182*b* are sized such that a predetermined viscous friction resistance is encountered by a fluid positioned in the fluid chambers 178 and 180 (e.g., hydraulic fluid, water, pressurized gas, or any other fluid), and the adjustment member 184 may be selectively moved to regulate the flow resistance such that movement of the splints 112*e* or 112*f* relative to the housing 172 is impeded in all direction, at a substantially constant level, and at all angles or positions of the splints 112*e* or 112*f* relative to the housing 172. In some exemplary embodiments, the adjustable rotary dashpot assembly 174 may be configured to provide variable or adjustable impediment to the motion of the splints 112*e* or 112*f* depending on a speed of movement of the splints 112*e* or 112*f* relative to the housing 172, as will be appreciated by persons of ordinary skill in the art having the benefit of the instant disclosure.

As will be appreciated by persons of ordinary skill in the art, any desired combinations of the hinged arms 102, 102*a*, and 170 may be implemented with resistance braces according to the inventive concepts disclosed herein to provide resistance to one or more joints of a human body.

Resistance braces according to the inventive concepts disclosed herein are easy to use and effective in promoting muscle grow and building and toning muscles and adjacent tendons, joints, and other tissues.

From the above description, it is clear that the inventive concepts disclosed herein are well adapted and/or configured to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the scope and coverage of the inventive concepts disclosed and claimed herein.

What is claimed is:

1. A hinged arm assembly for a resistance brace, comprising:

first and second plates movably coupled with one another in an opposing spaced-apart relationship so that the first and second plates are selectively movable toward one another and away from one another, the first and second plates cooperating with one another to define a first pivot point and a second pivot point separated from the first pivot point by a first distance;

a first splint having a first limb-attachment portion and a first geared end positioned between the first and second plates and pivotably coupled with the first and second plates at the first pivot point; and a second splint having a second limb-attachment portion and a second geared end positioned between the first and second plates and pivotably coupled with the first and second plates at the second pivot point, the second geared end matingly engaging the first geared end so that the first and second splints are movable in unison with one another relative to the first and second plates, wherein the first and second plates and the first and second geared ends are coupled to and contact each other in a way that movable resistance between the first and second plates and the first and second geared ends is applied in all movement directions and such that the resistance between the first and second plates and the first and second geared ends is substantially constant and independent of the position of the first and second splints relative to the first and second plates.

2. The hinged arm assembly of claim 1, further comprising at least one friction member positioned between the first geared end and at least one of the first and second plates.

3. The hinged arm assembly of claim 2, wherein the at least one friction member comprises a rubber material.

4. The hinged arm assembly of claim 2, wherein the at least one friction member is a first friction member, further comprising a second friction member positioned between the second geared end and at least one of the first and second plates.

5. The hinged arm assembly of claim 1, wherein the second geared end matingly engages the first geared end such that the first and second splints are movable relative to the first and second plates between an extended position and one or more flexed positions.

6. The hinged arm assembly of claim 5, wherein the first and second pivot points cooperate with one another to define a first axis and the first splint defines a second axis, and wherein the first axis is angled relative to the second axis at an angle of between about 36° and about 44° when the first and second splints are in the extended position.

7. The hinged arm assembly of claim 1, further comprising:

an adjustable compression member coupled with the first and the second plates such that the adjustable compression member compresses the first and second plates against the first and second geared ends so as to frictionally impede movement of the first and second splints relative to the first and second plates, wherein the adjustable compression member is movable relative to at least one of the first and second plates between a first position where the adjustable compression member compresses the first and second plates against the first and second geared ends with a first compressive force and a second position where the adjustable compression member compresses the first and second plates against the first and second geared ends with a second compressive force different from the first compressive force.

8. A resistance brace, comprising:

a pair of hinged arms, each hinged arm including:

first and second plates movably coupled with one another in an opposing spaced-apart relationship so that the first and second plates are selectively movable toward one another and away from one another, the first and second plates cooperating with one another to define a first pivot point and a second pivot point separated from the first pivot point by a first distance;

a first splint having a first limb-attachment portion and a first geared end positioned between the first and second plates and pivotably coupled with the first and second plates at the first pivot point;

a second splint having a second limb-attachment portion and a second geared end positioned between the first and second plates and pivotably coupled with the first and second plates at the second pivot point, the second geared end matingly engaging the first geared end so that the first and second splints are movable in unison with one another relative to the first and second plates;

wherein the first and second plates and the first and second geared ends are coupled to and contact each other in a way that movable resistance between the first and second plates and the first and second geared ends is applied in all movement directions and such that the resistance between the first and second plates and the first and second geared ends is substantially constant and independent of the position of the first and second splints relative to the first and second plates;

at least one joint harness coupled with the pair of hinged arms and supporting the pair of hinged arms in an opposing spaced-apart relationship so that the pair of hinged arms are positionable on opposing sides of a joint relative to a plane of rotation of the joint;

a first attachment member coupled with the first splints of the pair of hinged arms and configured to attach the first splints to a first body portion extending from the joint; and a second attachment member coupled with the second splints of the pair of hinged arms and configured to attach the second splints to a second body portion extending from the joint.

9. The resistance brace of claim 8, wherein the joint is an elbow joint and wherein the first distance is between about 2 and about 4 centimeters.

10. The resistance brace of claim 8, wherein the resistance brace is movable between an extended position and two or more flexed positions.

11. The resistance brace of claim 10, wherein the pair of hinged arms are configured such that the resistance brace moves anatomically correctly relative to a joint so that the first and second attachment members are substantially stationary relative to the first and second body portions when the first and second attachment members are attached to the first and second body portions and the resistance brace is moved between the extended position and the two or more flexed positions.

12. The resistance brace of claim 11, wherein the first and second pivot points cooperate to define a first axis and the first splints define a second axis, and wherein the first axis intersects the second axis at an angle of between about 36° and about 44° when the resistance brace is in the extended position.

13. The resistance brace of claim 8, wherein at least one of the pair of hinged arms further comprises at least one friction member positioned between the first geared end and at least one of the first and second plates.

14. The resistance brace of claim 13, wherein the at least one friction member is a first friction member, and wherein the at least one of the pair of hinged arms further comprises a second friction member positioned between the second geared end and at least one of the first and second plates.

15. The resistance brace of claim 8, wherein the joint harness further comprises a joint cradle and a retaining strap coupled with the pair of hinged arms and separated at a distance from one another so that the joint cradle, the retaining strap, and the pair of hinged arms cooperate with one another to define a joint-receiving space therebetween.

16. The resistance brace of claim 8, wherein the resistance brace is configured to be worn by a user under normal clothing.

17. A hinged arm assembly for a resistance brace, comprising:

a housing defining a first pivot point and a second pivot point separated from the first pivot point by a first distance;

a first splint having a first limb-attachment portion and a first geared end pivotably coupled with the housing at the first pivot point;

a second splint having a second limb-attachment portion and a second geared end pivotably coupled with the housing at the second pivot point, the second geared end matingly engaging the first geared end so that the first and second splints are movable in unison with one another relative to the housing; and an adjustable rotary dashpot assembly incorporated in the housing and operably coupled with the first and the second splints such that the rotary dashpot assembly impedes movement of the first and second splints relative to the housing in all directions, wherein the adjustable rotary dashpot is configured so that the first and second plates and the first and second geared ends are coupled to and contact each other in a way that the resistance between the first and second plates and the first and second geared ends is applied in all movement directions and such that the resistance between the first and second plates and the first and second geared ends is substantially constant and independent of the position of the first and second splints relative to the first and second plates.

* * * * *